US010640920B2

(12) United States Patent
Worswick et al.

(10) Patent No.: US 10,640,920 B2
(45) Date of Patent: May 5, 2020

(54) WINCH LINE

(71) Applicant: Bubba Rope, LLC, Altamonte Springs, FL (US)

(72) Inventors: Douglas J. Worswick, Winter Park, FL (US); James A. Grass, Orlando, FL (US)

(73) Assignee: BUBBA ROPE, LLC, Altamonte Springs, FL (US)

( * ) Notice: Subject to any disclaimer, the term of this patent is extended or adjusted under 35 U.S.C. 154(b) by 578 days.

(21) Appl. No.: 15/338,273

(22) Filed: Oct. 28, 2016

(65) Prior Publication Data

US 2018/0119341 A1 May 3, 2018

(51) Int. Cl.

| | |
|---|---|
| ***D07B 1/18*** | (2006.01) |
| ***D07B 1/14*** | (2006.01) |
| ***D07B 1/16*** | (2006.01) |
| ***B66D 1/34*** | (2006.01) |

(52) U.S. Cl.

CPC ..... *D07B 1/185* (2013.01); *B66D 1/34* (2013.01); *D07B 1/148* (2013.01); *D07B 1/162* (2013.01); *D07B 1/18* (2013.01)

(58) Field of Classification Search

CPC ..... D07B 1/148; D07B 1/18; D07B 1/162; D07B 1/185

See application file for complete search history.

(56) References Cited

U.S. PATENT DOCUMENTS

| | | | | |
|---|---|---|---|---|
| 1,915,843 | A | 6/1933 | Stanley | |
| D134,502 | S | 12/1942 | Bromm | |
| D199,989 | S | 1/1965 | Hoff | |
| 3,163,902 | A * | 1/1965 | Bernburg | F16G 11/048 403/369 |
| 3,385,252 | A | 5/1968 | Arne | |
| 3,692,361 | A * | 9/1972 | Ivarsson | B60R 22/22 297/482 |
| 3,932,697 | A * | 1/1976 | Hood | D07B 1/185 174/79 |
| 3,947,927 | A | 4/1976 | Rosenthal | |
| D254,160 | S | 2/1980 | Bruner | |
| 4,358,212 | A * | 11/1982 | Compton | F16G 11/146 24/115 K |
| 4,862,563 | A | 9/1989 | Flynn | |
| 4,903,911 | A | 2/1990 | Sepka | |
| 4,982,885 | A | 1/1991 | Severson et al. | |
| D315,492 | S | 3/1991 | Prihoda | |
| D324,644 | S | 3/1992 | Jacobs | |
| 5,104,076 | A | 4/1992 | Goodall, Jr. | |
| 5,130,899 | A | 7/1992 | Larkin et al. | |
| 5,131,118 | A | 7/1992 | Breeher | |

(Continued)

*Primary Examiner* — Shaun R Hurley

(74) *Attorney, Agent, or Firm* — Dorsey & Whitney LLP

(57) ABSTRACT

A winch line includes a length of synthetic rope having a connector end and a terminal end. An eye is formed by a splice at the connector end of the synthetic rope. An elastomeric coating encapsulates the eye. An elastomer mass is formed over and encapsulates a base portion of the eye and a portion of the splice. The winch line has a number of intermediate sections of consistent length along the length of the synthetic rope extending between the elastomer mass and the terminal end. A number of demarcations reside on a surface of the synthetic rope indicating a boundary between the intermediate sections.

17 Claims, 6 Drawing Sheets

(56) References Cited

U.S. PATENT DOCUMENTS

| | | | | |
|---|---|---|---|---|
| 5,136,759 | A | 8/1992 | Armour | |
| D341,079 | S | 11/1993 | Crowe | |
| D363,427 | S | 10/1995 | Crowe | |
| 5,548,871 | A | 8/1996 | Trethewey | |
| D385,079 | S | 10/1997 | Griffin | |
| 5,921,529 | A | 7/1999 | Wilson et al. | |
| 6,049,953 | A | 4/2000 | Mccay et al. | |
| 6,089,008 | A * | 7/2000 | Lucius | B29C 45/14467 57/22 |
| D556,420 | S | 11/2007 | Trihey et al. | |
| D712,749 | S | 9/2014 | Robertson | |
| D721,214 | S | 1/2015 | Trochum | |
| D798,522 | S | 9/2017 | Scheer | |
| D799,145 | S | 10/2017 | Scheer | |
| 2003/0121944 | A1 | 7/2003 | Scanlan et al. | |
| 2011/0052314 | A1 * | 3/2011 | Lindsey | B66C 1/12 403/210 |
| 2013/0014354 | A1 | 1/2013 | Robbins | |
| 2013/0145740 | A1 * | 6/2013 | Schulz | D07B 1/185 57/231 |
| 2016/0168786 | A1 * | 6/2016 | Bueno | D07B 1/185 57/202 |
| 2016/0221805 | A1 * | 8/2016 | Munuswamy | B66C 23/06 |
| 2017/0096793 | A1 * | 4/2017 | Patenaude | D07B 1/005 |
| 2017/0353017 | A1 * | 12/2017 | Ward | D07B 1/14 |

* cited by examiner

WINCH LINE

TECHNICAL FIELD

The technology described herein relates to winch lines and primarily to winch lines made of synthetic rope and to methods for attaching winch lines to winch drums.

BACKGROUND

High tensile strength, synthetic rope has been developed and used in towing and winching applications due to its lighter weight than steel cable and its higher strength under tension than steel cable of the same diameter. In fact, ropes woven of high-modulus polyethylene (HMPE) (e.g., Plasma, Spectra, Dyneema and Amsteel) are rated for many high load and tension applications including towing, winching, and mooring. Among other characteristics, HMPE rope has a high resistance to abrasion and ultraviolet degradation and a low percentage of elongation. A synthetic winch line that is unsheathed will be more susceptible to chafing. It must be kept free of sand and grit that can work their way into and between the strands of the rope and cause internal abrasion. The winch line should further be covered during the day so that UV rays don't damage the rope.

It is also more vulnerable to heat, whether it comes from chafing or the internal drum brake. Depending upon the formulation of the synthetic rope, temperatures between 150 and 450 degrees Fahrenheit can cause the rope to lose strength. These temperatures can be reached through heat transfer of the winch brake through the winch drum. If the rope repeatedly reaches these high temperatures, "heat aging" occurs, which extremely weakens the rope. If the rope reaches a melting temperature between 290 and 900 degrees (depending on the formulation of the rope), the rope can melt. Thus, it is important to allow the brake to cool off as necessary when in use. However, waiting during these necessary cooling periods can significantly delay the operations needed to be performed by the winch and winch line.

Synthetic rope winch lines are often formed with eyes on the free end for attaching to rigging connectors such as shackles or hooks. The eyes are generally formed by slicing the synthetic rope into itself to form a loop or eye. They eyes are also often reinforced with a metal thimble that lines the inner wall of the rope forming the eye opening. The thimble provides abrasion resistance and helps maintain the form of the eye when placed under tension in order to avoid failure of the rope. Bends in the rope at too small a radius can significantly compromise the strength of the rope and can lead to failure. Thimbles can also act as a stopper or block to prevent the winch line from pulling through the fairlead when the winch line is retracted and wraps around the winch drum. However, as thimbles are typically metal, they can damage the fairlead if pulled against it tightly or by banging against the fairlead during transit if not pulled tightly against it. Such impacts can cause abrasions to, gouges in, or burs on to the fairlead through which the winch line rope travels. These abrasive features can rub or cut into the winch line as it travels through the fairlead, thus compromising the integrity of the winch line.

Presently, winch lines, both steel cable and synthetic rope, are typically attached to the winch drum at a single point by a either a set screw connecting a ferrule on the end of the winch line against the drum. Alternatively, the end of a synthetic winch line can be inserted into a hole in the drum, which creates a binding connection as the rope is bent and wrapped around the drum away from the hole. These configurations can lead to failure of the winch line if too much line is played out off of the drum. If winch line is not wrapped around the winch drum enough times past the connection point to maintain a strong grip or bite between the winch line and the drum, the tension on the winch line can easily pull the winch line out from under the set screw or out of the hole and result in failure.

The information included in this Background section of the specification, including any references cited herein and any description or discussion thereof, is included for technical reference purposes only and is not to be regarded subject matter by which the scope of the invention as defined in the claims is to be bound.

SUMMARY

In one illustrative form, the technology disclosed herein is directed to a synthetic rope winch line. The winch line may include a length of synthetic rope having a connector end and a terminal end. An eye may be formed in the synthetic rope by a splice at the connector end of the synthetic rope. An elastomeric coating may encapsulate the eye. An elastomer mass may be formed over and encapsulate a base portion of the eye adjacent to the splice and further extend over and encapsulate a portion of the splice. The winch line may further have number of intermediate sections of consistent length along the length of the synthetic rope extending between the elastomer mass and the terminal end. A number of demarcations may reside on a surface of the synthetic rope indicating a boundary between the intermediate sections.

A device for attaching a winch line to a winch drum is disclosed as another illustrative implementation. A winch line retainer may be formed as a strap defining a first retention loop at a first lateral end of the strap, a second retention loop at a second lateral end of the strap, and a mid-section that connects the first retention loop and the first lateral end and the second retention loop at the second lateral end. The mid-section provides a separation distance between the first retention loop and the second retention loop.

A method for attaching a synthetic rope winch line to a winch drum is also disclosed herein. The method may include the following steps. A winch line retainer may be provided in the form of a strap defining a first retention loop at a first lateral end of the strap, a second retention loop at a second lateral end of the strap, and a mid-section that connects the first retention loop and the first lateral end and the second retention loop at the second lateral end. The mid-section provides a separation distance between the first retention loop and the second retention loop. The method may further include the following steps. The winch line retainer may be affixed to a drum shaft of the winch drum. A terminal end of the winch line may be inserted through the first retention loop of the winch line retainer. The terminal end of the winch line may be wrapped around the drum shaft and over the midsection of the winch line retainer a number of turns. The terminal end of the winch line may be inserted through the second retention loop of the winch line retainer.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

Figure 1:
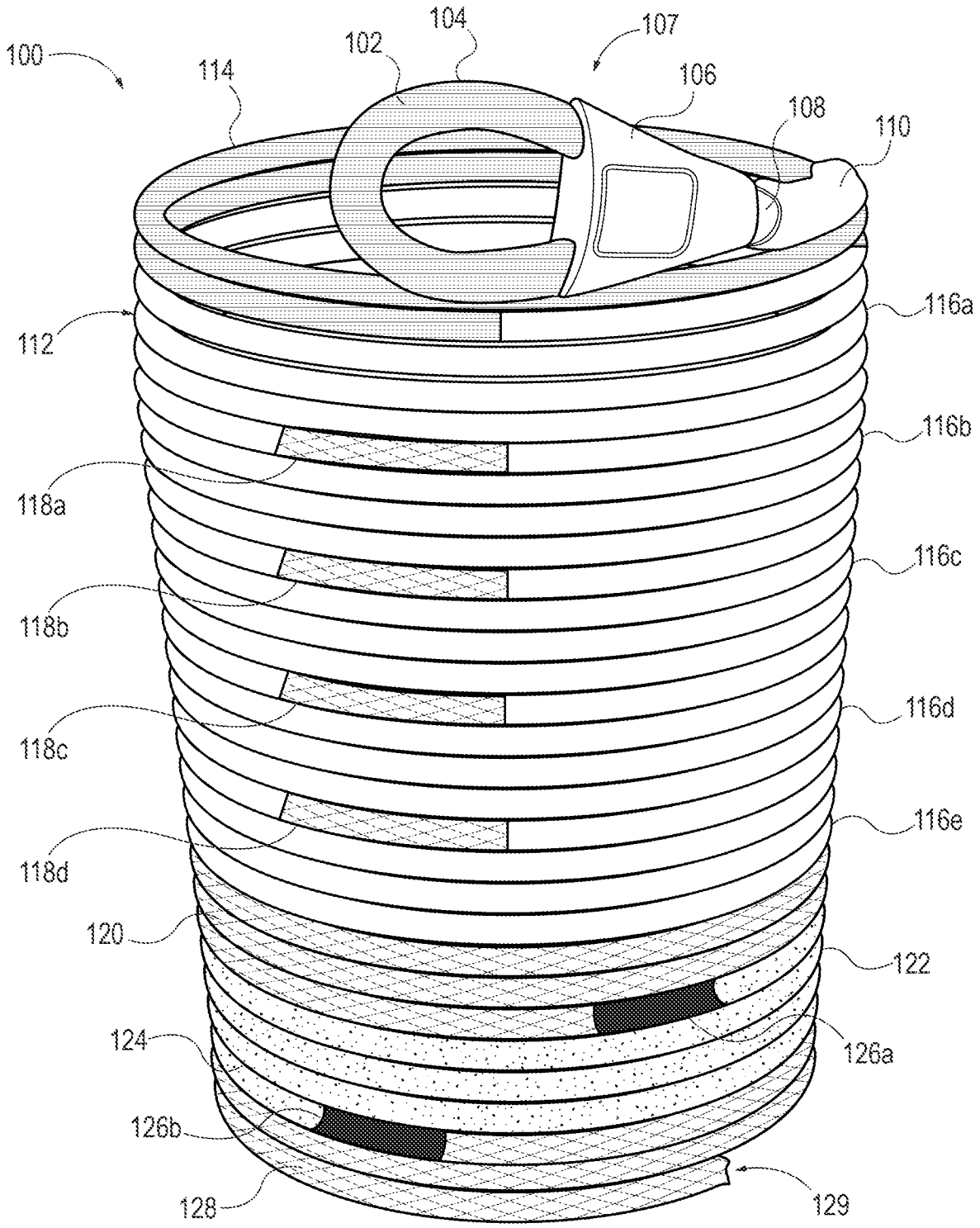
FIG. 1 is an isometric view of an illustrative winch line.

An illustrative implementation of a synthetic winch line 100 with a number of innovative features is depicted in FIG. 1. In some illustrative embodiments, the winch line may be constructed from a synthetic rope 115 made of woven high-modulus polyethylene (HMPE). The winch line 100 in FIG. 1 is shown in a coiled configuration for ease of presentation as typical winch lines range from many tens of feet to over 100 feet in length and more. It may be desirable to form an eye 102 in a free end of the winch line 100 for easily connecting the winch line 100 to other devices, for example, a hook, a clevis, a carabiner, or other similar device, through which the winch line 100 may be easily attached to a load for towing, winching, lifting, or lowering the load.

The eye 102 may be formed at a first end of the winch line 100 by splicing the rope 115 forming the winch line 100 with itself. Such splicing typically involves connecting a free end of the rope 115, also called the bury end 103 (see FIG. 3), to a fid. The fid is then inserted between braided strands of the rope 115 at an insertion location into a core 103 surrounded by the braided strands. The fid is advanced within the core 105 of the rope 115, thereby pulling the bury end 103 of the rope 115 within the core 105. The fid exits from between braided strands of the rope 115 at a distance spaced apart from the insertion location. The bury end 103 is disconnected from the fid and is retracted within the center core 105 and is fully contained therein to form the splice 108. When under tension, the rope 115 elongates and the circumference of the rope weave reduces to compress the bury end 103 within the center core 105. This radially inward compression force holds the bury end 103 within the outer rope section to maintain the strength of the splice 108. The bury end 103 may further be held in place within the core 105 by a number of stitches 113 of heavy weight thread or small gauge cord that passes through both the outer rope section and the bury end 103 within the core 105. The stitching 113 may be applied across the rope 115 on a number of different sides of the splice 108 and at a number of different positions longitudinally along the splice 108.

In contrast, steel cables cannot generally be spliced and while loops or eyes can be formed, a ferrule must be crimped in place with a specialized crimping tool to hold two parallel wire cable sections together or a number of U-clamps may be bolted in place for the same purpose. In each case, the joint is rough and sharp and may not achieve the same strength as a rope splice.

Figure 2:
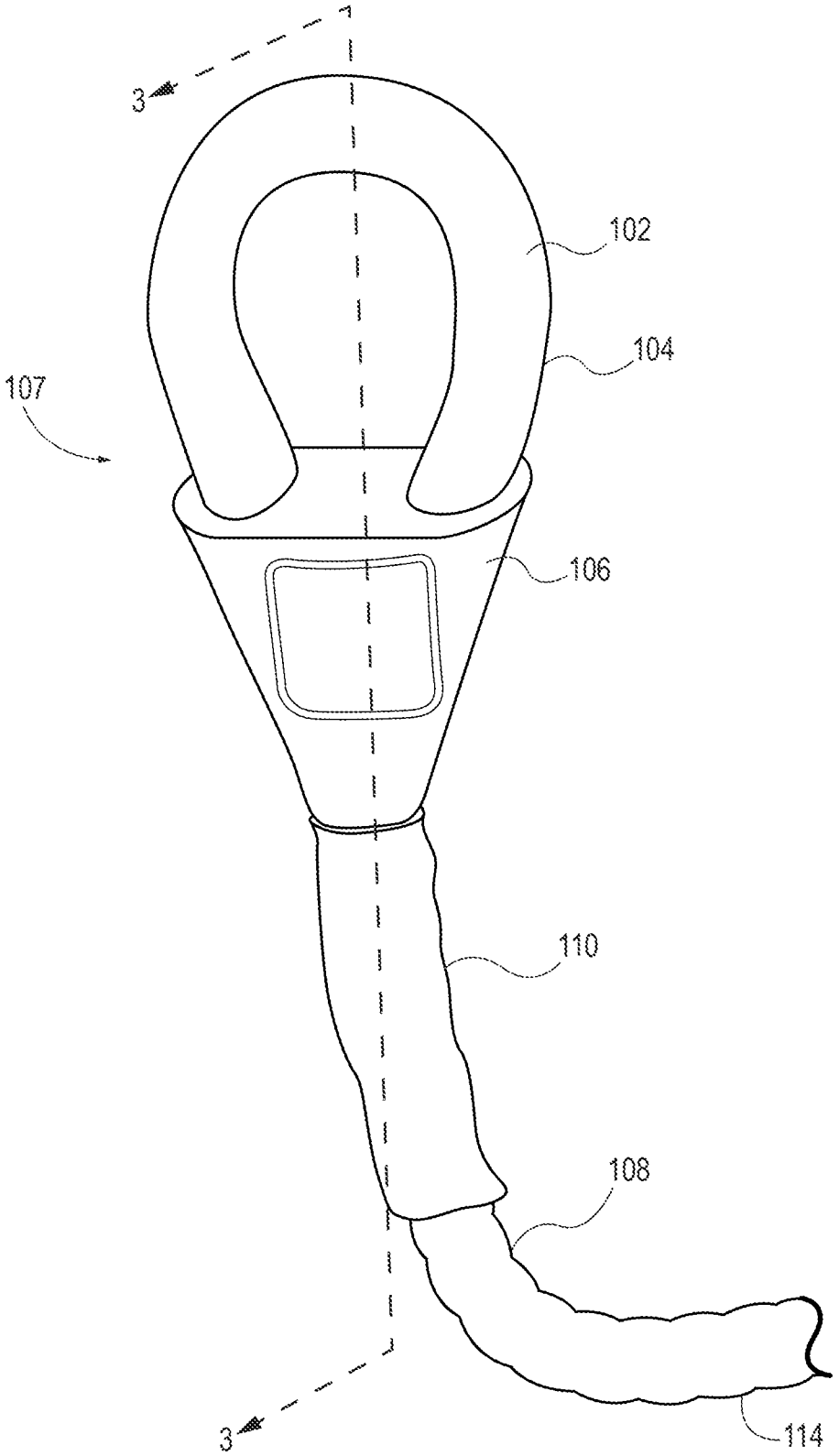
FIG. 2 is an isometric view of an eye loop on an end of the winch line of FIG. 1 including a synthetic thimble formed thereon.
Figure 3:
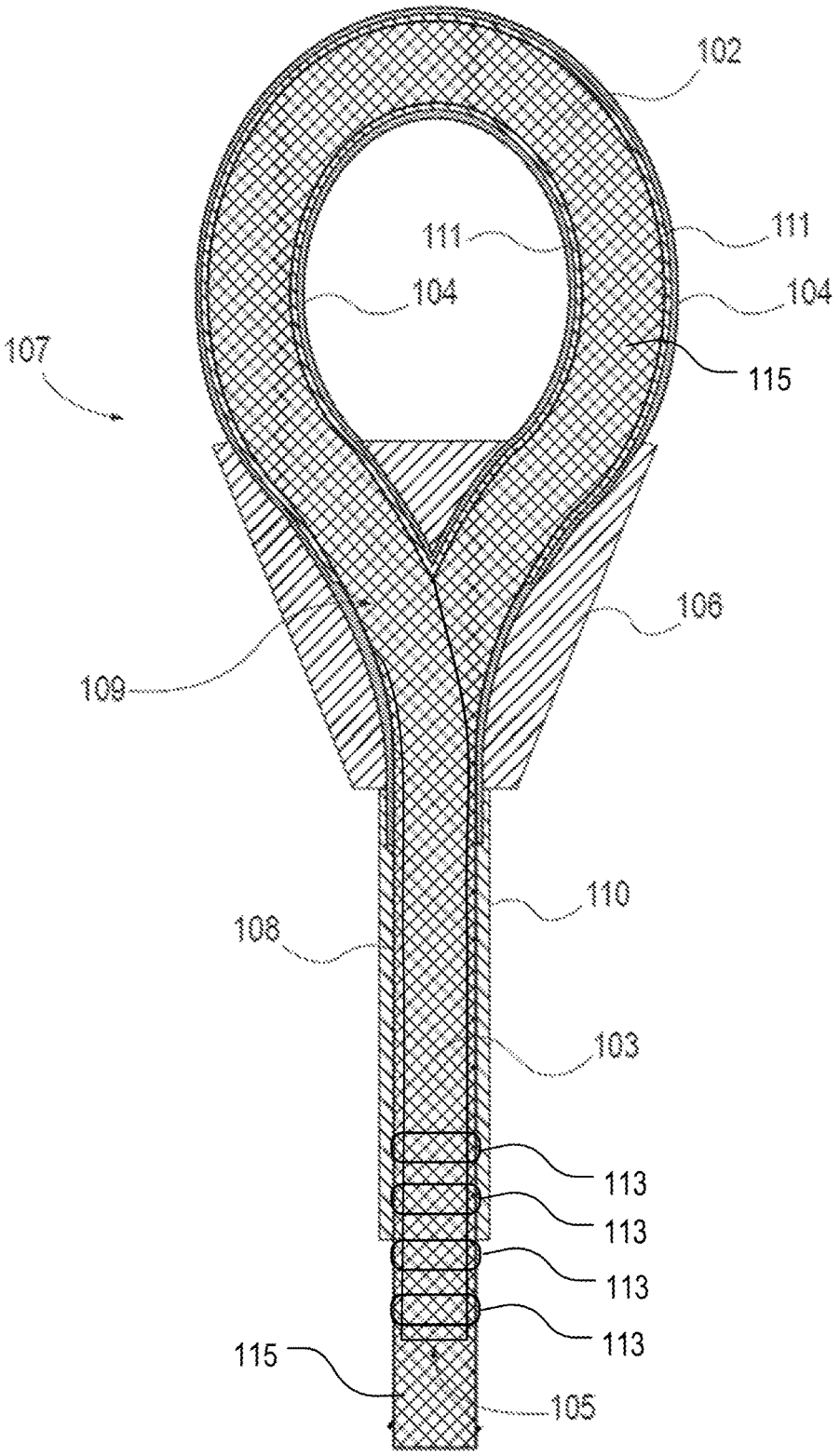
FIG. 3 is an elevation view in cross section of the eye loop and synthetic thimble as indicated by line 2-2 in FIG. 2.

In lieu of a typical metal thimble used to reinforce and maintain the shape of an eye in the free end of a winch line, the present disclosure contemplates the use of a synthetic thimble 107. As shown in FIGS. 1-3, the eye 102 of the winch line 100 may be covered by a tubular sleeve 111 made, for example, of a double braided nylon or polyester for additional strength and abrasion resistance. The eye 102 of the winch line 100 may further be coated with a strong, abrasion resistant elastomer to form a thimble coating 104 over and around the tubular sleeve 111 as well as along the splice 108. In some illustrative embodiments, a two-component, high-performance polyurethane elastomer may be used to coat the eye 102 and some or all of the splice 108. Two-component, high-performance elastomers have high tensile and tear propagation strengths as well as very good resistance to abrasion and cutting. Such elastomers also have good resistance to oil. The elastomer may be applied in a thickness of between 1/16 in. and 1/8 in.

In addition to surface coating the eye 102 and the splice 108, a thimble stopper 106 may be molded around the splice point 109 at the base of the eye 102 to encapsulate the base of the eye 102 and the top of the splice 108. The thimble stopper 106 may be formed by an insert molding process. The splice point 109 may be inserted within a mold and a two-component, high-performance polyurethane elastomer of the same or similar formulation as the coating on the eye 102 may be injected into the mold to surround the splice point 102 to form a triangular or trapezoidal rubber mass around the splice point 109. The thimble stopper 106 may further aid in preventing the bury end 103 of the rope in the splice 108 from pulling out under tension due to adhesion between the elastomer of the stopper and the thimble coating 104 on the eye 102, which bonds to the strands forming the rope weave of the winch line 100.

The size of the thimble stopper 106 may be selected such that it is larger in each dimension than a standard opening of a winch fairlead for the diameter of rope used for the winch line 100. The elastomer thimble stopper 106 may thus function to prevent the eye 102 from passing through the fairlead and getting stuck within or behind the fairlead opening on the winch.

The polyurethane elastomer coating 104 on the eye 102 and the formed thimble stopper 106 together create the synthetic thimble 107 with a relatively rigid eye 102 that holds its shape and provides protection to the encapsulated winch line 102 in the eye 102 when connected with rigging devices. Unlike metal thimbles used to reinforce rope eyes, the synthetic thimble 107 has some elasticity, which may be helpful in some tight rigging applications. The synthetic thimble 107 is also lighter than a metal thimble and may cause less damage or injury than a metal thimble should a rigging component fail and the winch line 100 snap back and inadvertently strike a structure or person due to an instantaneous release of tension on the winch line 100.

A protective sleeve 110 may be placed over the splice 108 on the winch line 100 immediately below the thimble stopper 106 to further protect and maintain the integrity of the splice 108. The protective sleeve 110 may be made of an elastomeric material and may provide a compressive force radially inward on the splice 108 to resist creep of the bury end 103 within the splice 108. The protective sleeve may further provide added protection 110 of the winch line 110 when the winch line 100 is not in use and completely coiled.

In such a configuration, the protective sleeve 110 will be located within the opening of the fairlead and may provide added protection to the winch line 100 from any burs or abrasions on the fairlead that could cut or wear on the winch line 100 at this location while the winch line is furled.

The remaining length of the winch line extending from the eye 102 may also be coated with a vinyl layer that protects the rope from ultraviolet (UV) light damage, environmental abrasion (e.g., from dirt and rocks or burs on the fairlead), and intrusion from dust, dirt, sand, and mud. In one illustrative embodiment, the vinyl coating is provided in solution as a polymer organosol vinyl dispersion consisting of high molecular weight polymer having a composition of approximately 86% vinyl chloride and 14% vinyl acetate. In some embodiments, the entire length of the winch line 100 may have a vinyl coating 112, even the portions forming the eye 102, the bury end 103, and the splice 108. In some exemplary embodiments, the vinyl coating may range in thickness from between 1/32 in. to 1/16 in. The vinyl coating 112 may be applied to the remainder of the rope 115 after the winch line 100 is spliced to form the eye 102 and the synthetic thimble 107 is formed.

Figure 4:
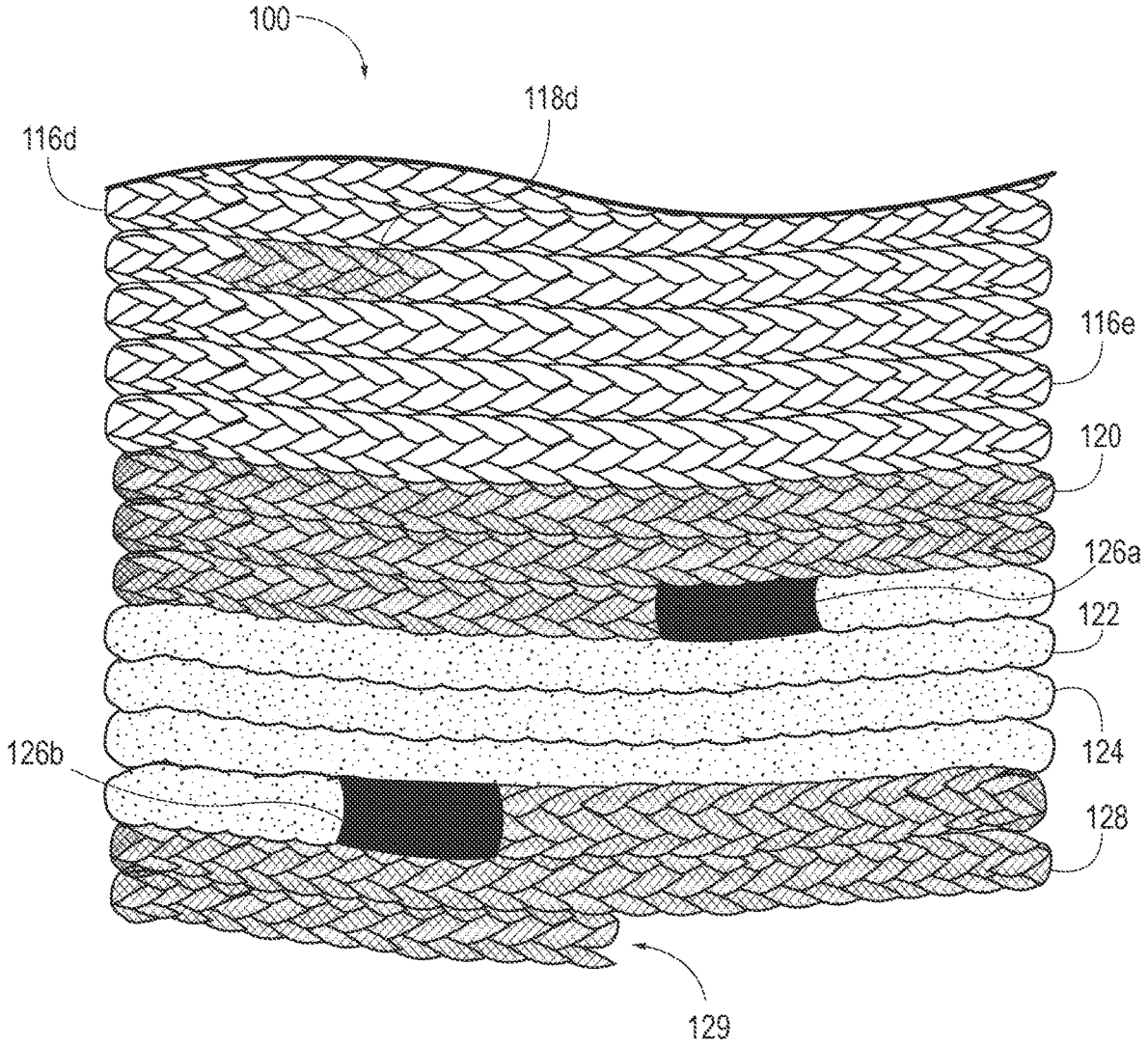
FIG. 4 is an enlarged view of a portion of the winch line of FIG. 1

The vinyl coating 112 may be provided in a variety of different colors for aesthetic or informational purposes. For example, as depicted in FIGS. 1 and 4, the winch line 100 may have color coded sections by using different colors of the vinyl coating 112 along certain lengths of the winch line 100. Color codes may be used to convey information, for example, a length of the winch line 100 unfurled from the winch, or may be used as a warning, for example, little length is left furled on the winch.

In the embodiment shown in FIGS. 1 and 4, an initial section 114 of the winch line 100 is coated with a vinyl coating 112 of a first color for a certain length, for example, 5 feet from the end of the eye 102. The winch line 100 may then be coated with a second color of a vinyl coating 112 over a first intermediate section 116*a* for a certain length, for example, a second section 10 feet long. At the end of the first intermediate section 116*a*, a narrow colored band of a third color of the vinyl coating 112 may be applied as a length marker 118*a* indicating the 10 foot length of the first intermediate section 116*a*. A number of successive intermediate sections 116*b/c/d/e* with the same color vinyl coating 112 separated by a number of successive indicators, demarcations, or length markers 118*b/c/d* of the third color vinyl coating 112.

The length markers 118*a/b/c/d* may be used to indicate successive common lengths of the winch line 100 as the winch line 100 is unfurled from the winch. In this manner, the length markers 118*a/b/c/d* provide the user with an easy visual indication of the length of winch line 100 unfurled from the winch drum. In the example of FIG. 1, five intermediate sections 116*a/b/c/d/e* of winch line are indicated by the four length markers 118*a/b/c/d* following the initial section 114, which in this illustrative example would equate to 50 feet of winch line 100 following the initial section 114. It should be understood that the winch line 100 may be made to any length and the length markers may be placed at any desired common distance apart in order to easily provide the user information to calculate the length of winch line 100 unfurled, as long as the user knows the incremental length between the length markers.

Following the intermediate sections 116*a/b/c/d/e* separated by the length markers 118*a/b/c/d*, the winch line 100 may be coated with a contrasting colored vinyl coating 112 to differentiate a warning section 120 from the final intermediate section 116*e*. In some embodiments, the warning section 120 may be the same color as the length markers. In other embodiments, the warning section may be a different color than any of the prior sections. The warning section 120 may be provided to indicate to the user that the usable length of the winch line 100 is close to being completely unfurled from the winch drum. In some exemplary embodiments, the warning section 120 may be 20 feet in length, but it may be more or less depending upon the desired design of the winch line 100.

Following the warning section 120, the winch line 100 may have a protected section 122, wherein a length of the winch line 100 is covered by a heat shield sleeve 122. The protected section 122 is close to a terminal end 129 of the winch line 100 that connects to a winch drum. The protected section 122 is typically a length of the winch line 100 that wraps around the winch drum and is thus exposed to high levels of heat generated by the winch brake that transfer through the winch drum. The heat shield sleeve 124 may be provided to protect the synthetic rope forming the winch line 100 from heat damage, including "heat aging," that can occur when the synthetic rope is exposed to high temperatures. Such heat damage can weaken the synthetic rope and lead to failure of the winch line 100. The heat shield sleeve 122 may be formed as a tubular textile sleeve manufactured from aramid yarns and may be heat resistant up to several hundred degrees Fahrenheit.

The heat shield sleeve 122 may be may be held in place over the protected section 122 by fastener sleeves 126*a/b* that extend around each end of the heat shield sleeve 122 and adjacent lengths of the exposed winch line 100 beyond the ends of the heat shield sleeve 124. The fastener sleeves 126*a/b* may be made of an elastomeric material and may provide a compressive force radially inward on each end of the heat shield sleeve 122 to resist movement of the ends of the heat shield sleeve 122 along the winch line 100.

In this illustrative embodiment, the winch line 100 may further be provided with an attachment section 128 extending beyond the protected section 122 covered by the heat shield sleeve 124. The attachment section 128 may be provided to cooperate with an attachment device, further described herein below, that helps securely fasten the winch line 100 to the winch drum. In a proposed exemplary implementation, the attachment section 128 may be of a length sufficient to wrap around the circumference of the winch drum on which the winch line 100 is used at least five complete times. In this manner, a sufficient length of the winch line 100 may be retained around with winch drum to prevent the winch line 100 from inadvertently releasing from the winch drum when the winch line 100 is under tension. The attachment section 128 may further be unshielded to allow the vinyl coating 112 and the synthetic rope in the attachment section to form an adhesive bond with the winch drum as a result of high temperatures transferred from the drum brake to cause a partial melt of the vinyl coating 112 along the attachment section 128. This adhesion between the attachment section 128 and the winch drum further helps affix the winch line 100 securely to and retain the winch line 100 around the winch drum.

Figure 5:
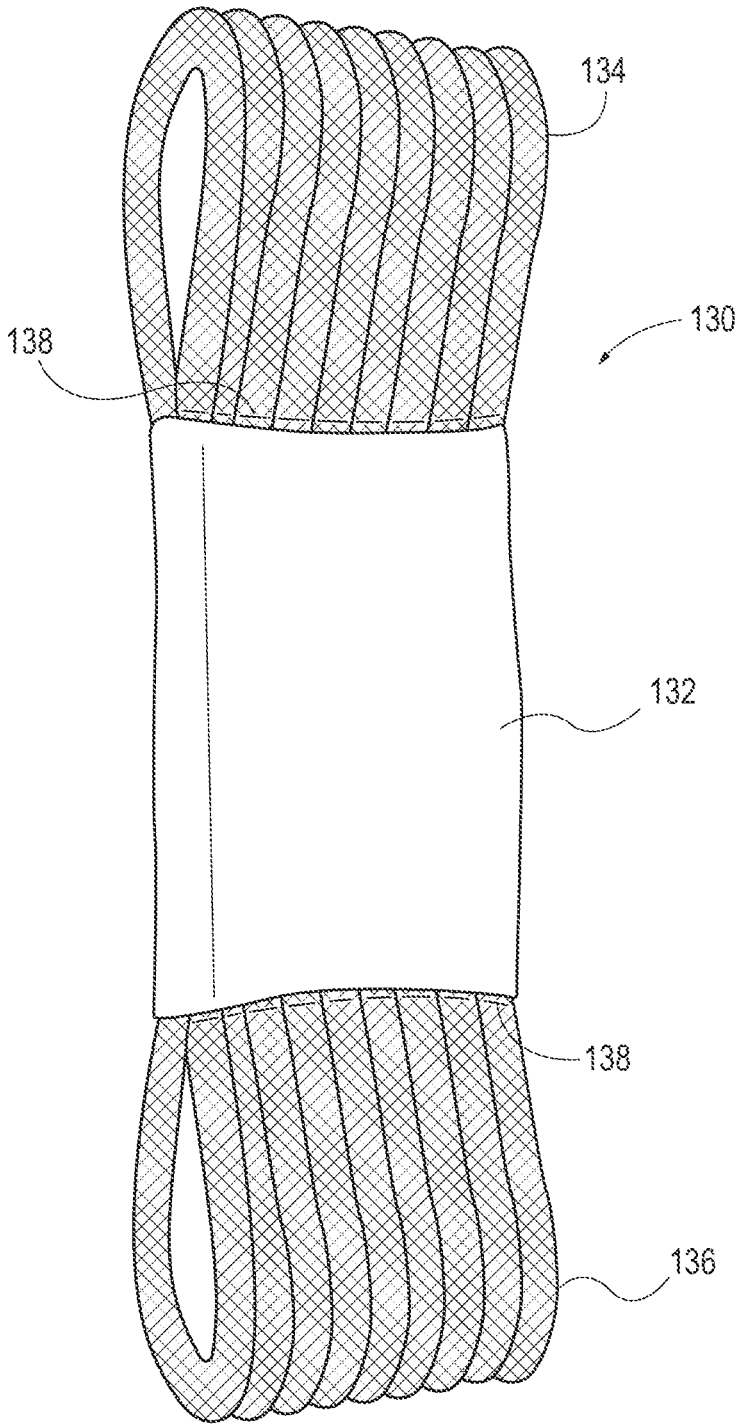
FIG. 5 is an isometric view of a winch line attachment aid.

A winch line retainer 130 is depicted in FIG. 5 and may be used as an attachment device for securing a winch line to a winch drum. The winch line retainer 130 may be a strap of material, for example, a length of flat woven webbing (e.g., polyester or nylon webbing) the ends of which are folded toward a center of the webbing to create a first retention loop 134 and a second retention loop 136 on opposing lateral ends of the winch line retainer 130. The ends of the webbing may be fastened to the center of the webbing with stitching 138 or any other appropriate fastening structure. In this manner, the winch line retainer 130 may be understood to be similar in form to a bow tie. A separation band 132 may be provided around the center of the winch line retainer 130 between the first and second retention loops 134, 136 to further retain and cover the ends of the webbing. The separation band 132 may be made of an elastomeric material that may form fit around the middle of the winch line retainer 130. The separation band 132 may further provide a surface for fastening the winch line retainer 130 to a winch drum as further described below. The length of the separation band 132, and thus the distance between the first and second retention loops 134, 136, may be designed to receive a certain number of turns of the winch line, for example, four. The first and second retention loops 134, 136 may also be configured to have a diameter sufficiently large to allow the diameter of the chosen winch line 100 to pass therethrough.

Figure 6:
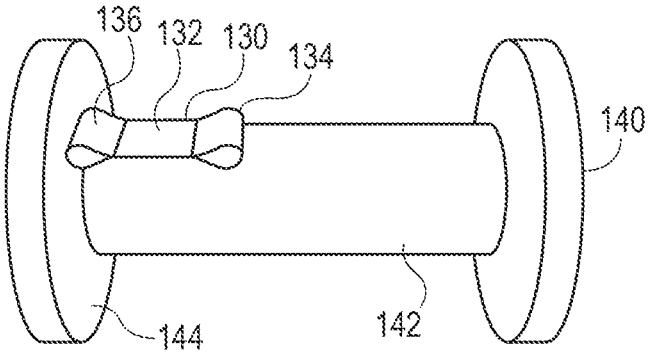
FIG. 6 is a perspective view of the winch line attachment aid of FIG. 5 positioned on a winch drum.
Figure 7:
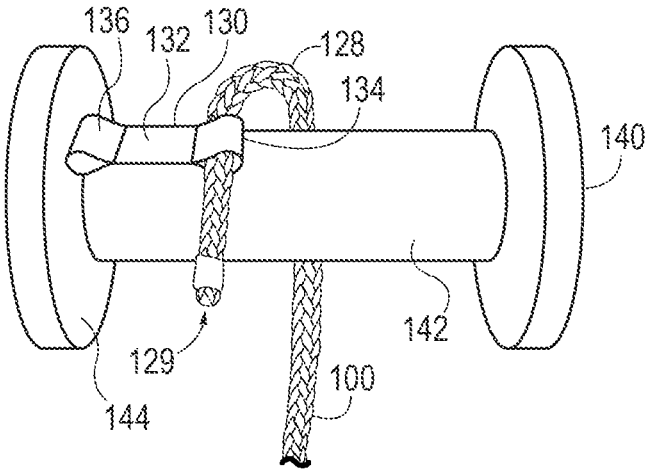
FIG. 7 is a perspective view of an initial attachment step for attaching a winch line to a winch drum using the winch line attachment aid.
Figure 8:
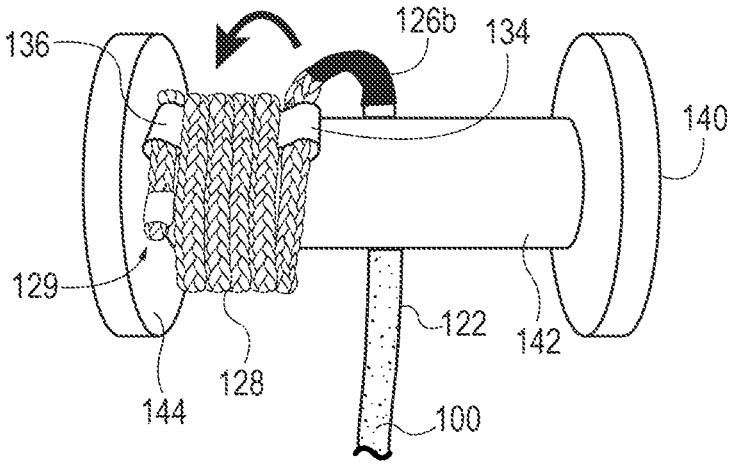
FIG. 8 is a perspective view of a completed configuration for attaching a winch line to a winch drum using the winch line attachment aid.

FIGS. 6-8 schematically depict a method for attaching a synthetic rope winch line 100 to a winch drum 140 using the winch line retainer 130 of FIG. 5. It should be appreciated that the winch line retainer 130 may be used to attach any type of synthetic winch line to any type of winch drum 140. This disclosure should in no way be considered to limit the use of the winch line retainer 130 with the embodiments of a winch line 100 disclosed herein.

Initially, an adhesive, for example, a piece of double stick tape (or any other tape, contact cement, or liquid adhesive), may be applied to one side of the separation band 132. The winch line retainer 130 may then be placed upon the drum shaft 142 of the winch drum 140 as shown in FIG. 6 with the adhesive on the separation band 132 in contact with the drum shaft 142. The winch line retainer 130 may be placed on the drum shaft 142 parallel to a longitudinal axis of the drum shaft 142 such that the second retention loop 136 is positioned adjacent to one of the end flanges 144 of the winch drum 140. The first retention loop 134 may thereby be positioned toward a center of the drum shaft 142.

As shown in FIG. 7, once the winch line retainer 130 is affixed to the drum shaft 142, the terminal end 129 of the winch line 100 (e.g., at the end of the attachment section 128 of the winch line 100 of FIGS. 1 and 4) may be directed underneath and around the back side of the winch drum 142 to be threaded or passed through the first retention loop 134 from a top side. The terminal end 129 of the winch line 100 may then be pulled further through the first retention loop 134 and wrapped around the winch drum 142 a number of times, each time passing over the separation band 132 and nesting adjacent to a prior turn of the rope. In some illustrative embodiments, for example, as shown in FIG. 8, the winch line 100 may wrap around the drum shaft 142 toward the end flange 144 such that it lays down in four passes over the separation band 132 to fill the distance between the first and second retention loops 134, 136. The terminal end 129 of the winch line 100 may then be threaded through the second retention loop 136 from a top opening of the second retention loop 136 and exit a bottom opening of the second retention loop. At this time, the primary length of the winch line 100 may be furled upon the drum shaft 142 through normal operation of the winch and rotation of the winch drum 140.

The winch line retainer 130 thus retains the terminal end 129 of the winch line 100 around the drum shaft 142 in a flat lay over a number of turns. The number of turns (e.g., five) may be chosen to ensure an adequate grip of the synthetic winch line 100 around the drum shaft 142 to prevent the winch line 100 from inadvertently pulling off of the winch when fully unfurled and under tension. The turns of the winch line 100 over the separation band 132 of the winch line retainer 130 hold the winch line retainer 130 in place on the drum shaft 142. As a result, the winch line 100 cannot unfurl from the winch drum 140 further than the position of the winch line 100 within the first retention loop 134. The wraps of the winch line 100 over the separation band 132 prevent movement of the first retention loop 134 and the winch line 100 will thus bind against the first retention loop 134 when fully unfurled and under tension. Further, in view of testing, it has been found that five wraps of the winch line 100 around the drum shaft 142 are adequate to prevent slippage of the winch line 100 around the shaft and through and out of the first and second retention loops 134, 136 when the winch line 100 is fully unfurled and under tension. In this manner, the winch line retainer 130 provides a safe and secure device and corresponding method for attaching a synthetic winch line to a winch drum.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order, and relative sizes reflected in the drawings attached hereto may vary.

The above specification, examples, and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A synthetic rope winch line comprising a length of synthetic rope having a connector end and a terminal end;

an eye formed by a splice at the connector end of the synthetic rope;

an elastomeric coating on the eye;

an elastomer mass formed over and encapsulating the elastomeric coating on a base portion of the eye adjacent to the splice and further extending over and encapsulating a portion of the splice;

a number of intermediate sections of consistent length along the length of the synthetic rope extending between the elastomer mass and the terminal end; and a number of demarcations on a surface of the synthetic rope indicating a boundary between the intermediate sections.

2. The synthetic rope winch line of claim 1, wherein the elastomeric coating is a two-component, high-performance polyurethane elastomer.

3. The synthetic rope winch line of claim 1, wherein the elastomer mass is a two-component, high-performance polyurethane elastomer.

4. The synthetic rope winch line of claim 1, wherein the elastomer mass is in a form of a trapezoid.

5. The synthetic rope winch line of claim 1 further comprising a heat shield sleeve positioned along an intermediate length of the synthetic rope, beyond the intermediate sections away from the eye, and spaced apart from the terminal end such that a further length of unshielded synthetic rope extends between the heat shield sleeve and the terminal end.

6. The synthetic rope winch line of claim 1, wherein the synthetic rope is made of woven high-modulus polyethylene (HMPE).

7. The synthetic rope winch line of claim 1, wherein the length of synthetic rope has a high molecular weight polymer coating.

8. The synthetic rope winch line of claim 7, wherein the high molecular weight polymer coating is a vinyl coating.

9. The synthetic rope winch line of claim 8, wherein the vinyl coating is a polymer organosol vinyl dispersion consisting of high molecular weight polymer.

10. The synthetic rope winch line of claim 8, wherein at locations of the demarcations, the vinyl coating is of a first color; and along the intermediate sections, the vinyl coating is of a second color that is different from the first color.

11. The synthetic rope winch line of claim 10 further comprising a warning section positioned between a final one of the intermediate sections and the terminal end, wherein the vinyl coating on the warning section is of a third color that is different from the second color.

12. The synthetic rope winch line of claim 11 further comprising a heat shield sleeve positioned along an intermediate length of the synthetic rope, beyond the warning section away from the eye, and spaced apart from the terminal end such that a further length of unshielded synthetic rope extends between the heat shield sleeve and the terminal end.

13. A synthetic rope winch line comprising a length of synthetic rope having a connector end and a terminal end;

an eye formed by a splice at the connector end of the synthetic rope;

an abrasion resistant thimble coating on the eye;

a rubber thimble stopper formed over and encapsulating the abrasion resistant thimble coating on a base portion of the eye adjacent to the splice and further extending over and encapsulating a portion of the splice, where in the rubber thimble stopper is formed of high molecular weight polymer.

14. The synthetic rope winch line of claim 13, wherein the abrasion resistant thimble coating is an elastomeric coating.

15. The synthetic rope winch line of claim 14, wherein the abrasion resistant thimble coating is a two-component, high-performance elastomer.

16. The synthetic rope winch line of claim 13, wherein the high molecular weight polymer of the rubber thimble stopper is a two-component, high-performance polyurethane elastomer.

17. The synthetic rope winch line of claim 13, wherein the rubber thimble stopper is in a form of a trapezoid.

* * * * *